US006561831B1

(12) United States Patent
McHugh et al.

(10) Patent No.: US 6,561,831 B1
(45) Date of Patent: May 13, 2003

(54) HOUSING OF SOCKET CONNECTOR AND CONDUCTIVE TERMINAL THEREOF

(75) Inventors: Robert G. McHugh, Golden, CO (US); Hsiu-Yuan Hsi, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/033,547

(22) Filed: Dec. 27, 2001

(51) Int. Cl.[7] ..... H01R 13/625
(52) U.S. Cl. ..... 439/342; 439/83
(58) Field of Search ..... 439/342, 83, 876

(56) References Cited

U.S. PATENT DOCUMENTS 4,498,725 A * 2/1985 Bright et al.
5,833,483 A * 11/1998 Lai et al. ..... 439/342
6,059,593 A * 5/2000 Pei et al. ..... 439/342
6,142,810 A * 11/2000 Hsiao et al. ..... 439/342
6,152,757 A * 11/2000 Szu ..... 439/342
6,159,032 A * 12/2000 McHugh et al. ..... 439/342
6,319,038 B1 * 11/2001 Howell et al. ..... 439/342
6,450,826 B1 * 9/2002 Howell et al. ..... 439/342
6,461,183 B1 * 10/2002 Ohkita et al. ..... 439/342
6,471,534 B1 * 10/2002 Lee ..... 439/342
6,471,535 B1 * 10/2002 Walkup et al. ..... 439/342

* cited by examiner

*Primary Examiner*—Gary Paumen
(74) *Attorney, Agent, or Firm*—Wei Te Chung

(57) ABSTRACT

A connector includes a housing having top and bottom faces. The housing defines an array of cells and each cell has an opening in the top face and a closed bottom with a slit defined in the bottom and exposed to the bottom face of the housing. A bump is formed on the bottom face next to each slit. A conductive terminal made by a first forming operation carried out on a metal plate is received in each cell through the top opening. The terminal has a base section positioned in the cell and a solder pad connected to the base section by a neck portion. The base section, the solder pad and the neck portion are substantially coplanar. The solder pad and the neck portion extend through the slit and beyond the bottom face of the housing. A second forming operation is carried out on the neck portions of all the terminals to bend all the neck portions about the bumps whereby the solder pads are substantially parallel to the bottom face. The neck portions are subject to an over-forming operation so as to have a perfect alignment of the solder pads. The bump provides a spring back clearance for the over-forming operation.

1 Claim, 7 Drawing Sheets

HOUSING OF SOCKET CONNECTOR AND CONDUCTIVE TERMINAL THEREOF

BACKGROUND OF THE INVENTION

1. Field of the Invention

The present invention generally relates to a socket connector for mounting an electronic device, such as a central processing unit (CPU) module, to a circuit board, and more particular to a housing of the socket connector and a conductive terminal retained in the housing. A method for making a socket connector by two forming operations is also provided.

2. The Related Arts

Socket connectors for mounting an electronic device, such as a central processing unit (CPU) module, to a circuit board are well known and commonly used in the computer industry. FIG. 1 of the attached drawings shows an example of the socket connectors that is referred to as ZIF (Zero Insertion Force) socket connector. The socket connector, generally designated with reference numeral 10, comprises a housing 12 defining an array of open cells 14 in which conductive terminals 26 (FIG. 2) are received and a cover 16 movably supported on the housing 12. The cover 16 defines through holes 18 corresponding to the cells 14 of the housing 12. The cover 16 carries a CPU module 20 with pin legs 22 of the CPU module 20 extending through the holes 18 of the cover 16 and partially into the cells 14. An actuator 24 drives the cover 16 in such a manner to bring the pin legs 24 of the CPU module 20 into contact with the terminals 26 of the housing 12 thereby forming electrical connection therebetween. Examples of socket connectors of this type are also disclosed in U.S. Pat. Nos. 4,498,725, 5,833,483, 6,059,596, 6,142,810, and 6,159,032.

The housing 12 has a top face 28 and an opposite bottom face 30. The cells 14 defined in the housing 12 can be wide-open on either the top face 28 or the bottom face 30 for receiving the terminal 26 therein, respectively referred to as "top-loading" and "bottom-loading". In a top loading structure, the cell defined in the housing 12 has a closed bottom with a slit defined in the closed bottom for the extension of a tail of the terminal. The tails of the terminals in a top loading structure are maintained substantially straight for being soldered to a circuit board with the so-called "through-hole" technique. However, in a bottom loading structure, the tails of the terminals are bent to be substantially normal to the terminal to form a solder pad (such as the portion 32 of the terminal 26 shown in FIG. 2) for carrying solder balls that connect the terminals to a circuit board by means of the so-called "surface mount technique (SMT)". Since a bottom loading structure requires a wide opening of each cell in the bottom of the housing, it is in general difficult to firmly hold the terminal to perform a bending operation. Thus, the solder pad is usually formed before the terminal is loaded into the corresponding cell.

Since SMT provides an efficient way of mounting a socket connector to a circuit board, the SMT type socket connectors are prevailing recently. However, the SMT process requires the solder pads of all the terminals 26 to be substantially flush with each other or in perfect alignment. Forming the solder pads before the terminals 26 are loaded into the cells 14 of the housing 12 leads to troubles in ensuring that the solder pads 32 can be substantially flush with each other. This is because the terminals 26 may be loaded into the cells 14 to difference depth. Thus, a method employing a second forming operation for making the solder pad after the terminal is loaded into the corresponding cell to ensure perfect alignment of the solder pads is desired.

SUMMARY OF THE INVENTION

Thus, it is an object of the present invention to provide a socket connector having a housing that allows a second forming operation to be carried out on a terminal retained therein.

Another object of the present invention is to provide a socket connector having a housing firmly retaining a terminal in a cell thereof.

To achieve the above objects, in accordance with the present invention, a socket connector comprises a housing having top and bottom faces. The housing defines an array of cells and each cell has an opening in the top face and a closed bottom with a slit defined in the bottom and exposed to the bottom face of the housing. A bump is formed on the bottom face next to each slit. A conductive terminal made by a first forming operation carried out on a metal plate is received in each cell through the top opening. The terminal has a base section positioned in the cell and a solder pad connected to the base section by a neck portion. The base section, the solder pad and the neck portion are substantially coplanar. The solder pad and the neck portion extend through the slit and beyond the bottom face of the housing. A second forming operation is carried out on the neck portions of all the terminals to bend all the neck portions about the bumps whereby the solder pads are substantially parallel to the bottom face. The neck portions are subject to an over-forming operation so as to have a perfect alignment of the solder pads. The bump provides a spring back clearance for the over-forming operation.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
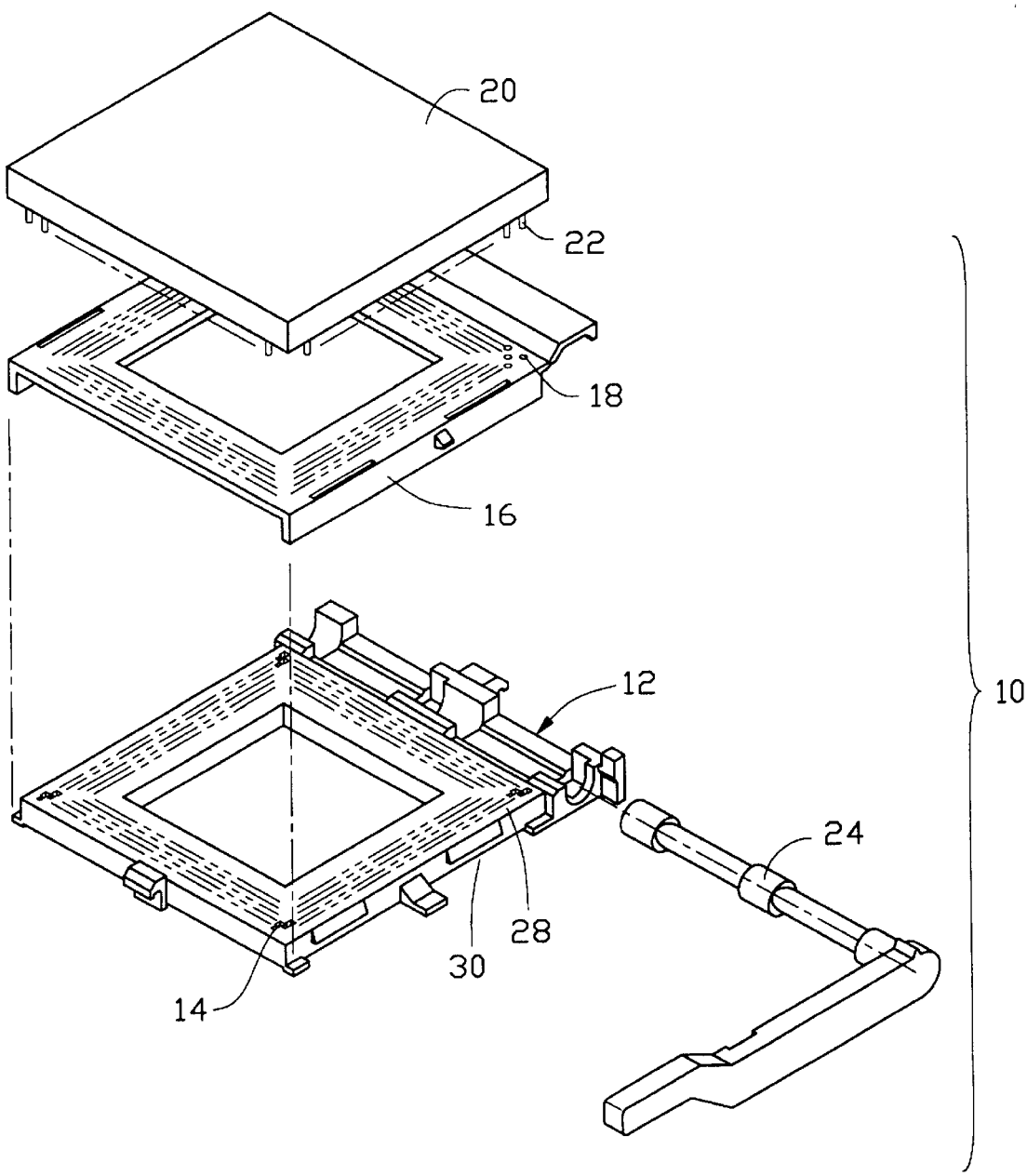
FIG. 1 (PRIOR ART)
FIG. 1 is an exploded view of a conventional socket connector.
Figure 2:
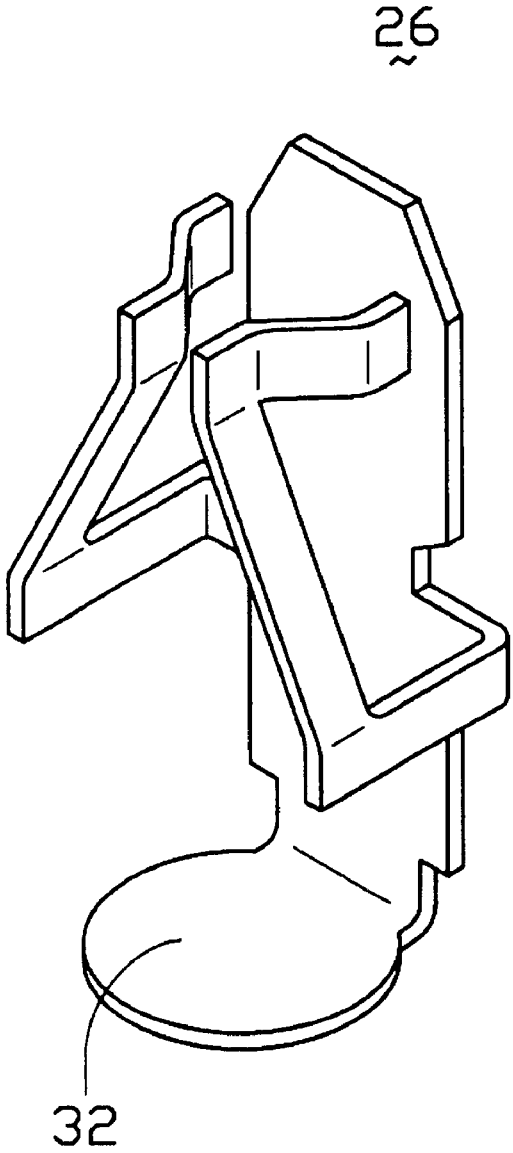
FIG. 2 (PRIOR ART)
FIG. 2 is a perspective view showing a conventional bottom-loading SMT type terminal of a socket connector.
Figure 3:
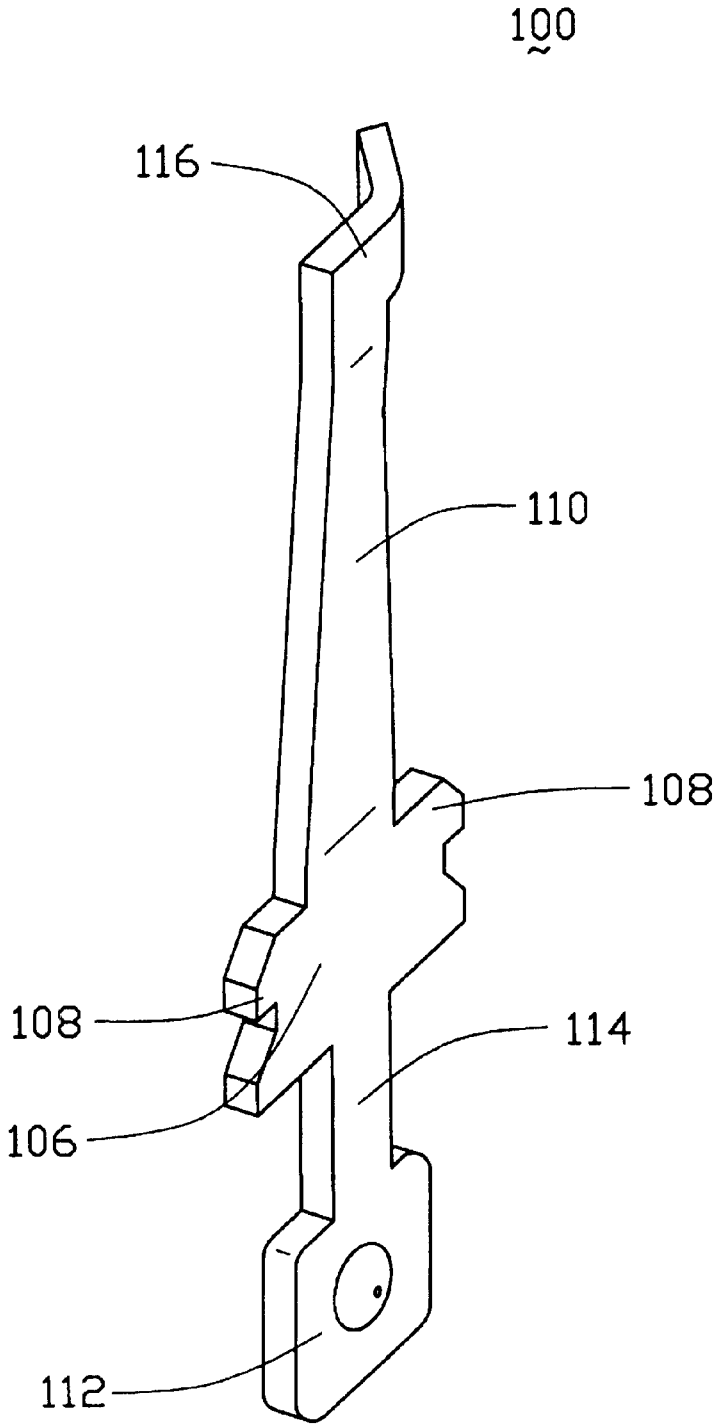
FIG. 3 is a perspective view of a top-loading terminal in accordance with the present invention.
Figure 5:
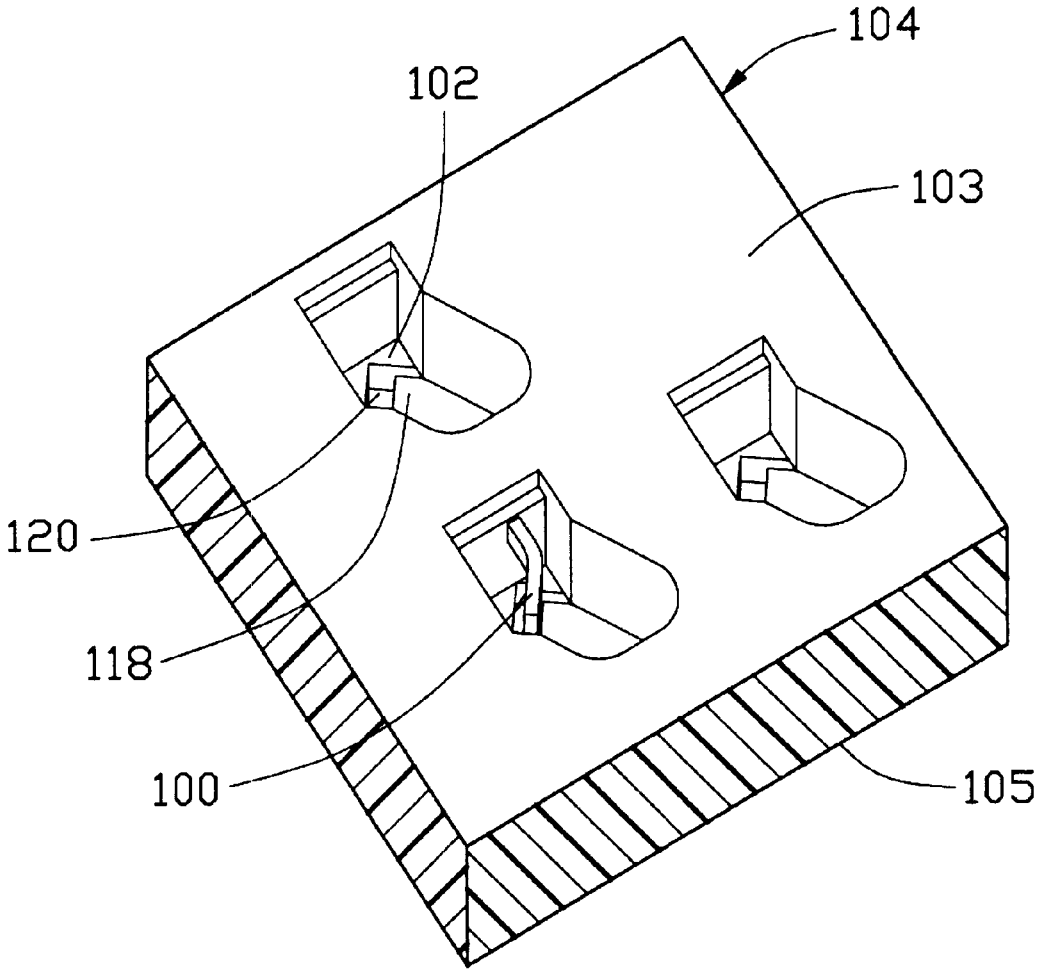
FIG. 5 is a top side perspective view of a portion of a housing of a socket connector in accordance with the present invention, some of the terminals being omitted for clarity.

With reference to the drawings and in particular to FIGS. 3 and 5, a conductive terminal constructed in accordance with the present invention, generally designated with reference numeral 100, is to be received and retained in a cell 102 defined in a housing 104 of a socket connector. The terminal 100 is made by stamping a metal plate (not shown) in a first forming operation and comprises a base section 106 having side extensions 108 on opposite side edges (not labeled) thereof, a slender beam 110 extending from a top edge of the base section 106 and a solder pad 112 connected to a bottom edge of the base section 106 by a neck portion 114. An arm 116 extends from a free end of the beam 110 for mechanically and electrically engaging with a pin leg of an electronic device (not shown). It is noted that the solder pad 112, the neck portion 114 and the base section 106 are substantially co-planar before a second forming operation is carried out. This will be further discussed.

The housing 104 has a top face 103 and an opposite bottom face 105. Each cell 102 of the housing 104 has an opening defined in the top face 103 and a closed bottom 118 with a slit 120 defined in the bottom 118 and exposed to the bottom face 105 of the housing 104. The terminal 100 is received in the cell 102 with the solder pad 112 and the neck portion 114 extending through the slit 120 and beyond the bottom face 105 of the housing 104. The base section 106 is interferentially fit in the slit 120. Alternatively, the base section 106 is retained in the cell 102 by means of the side extensions 108 positioned on the bottom 118 of the cell 120.

Figure 4:
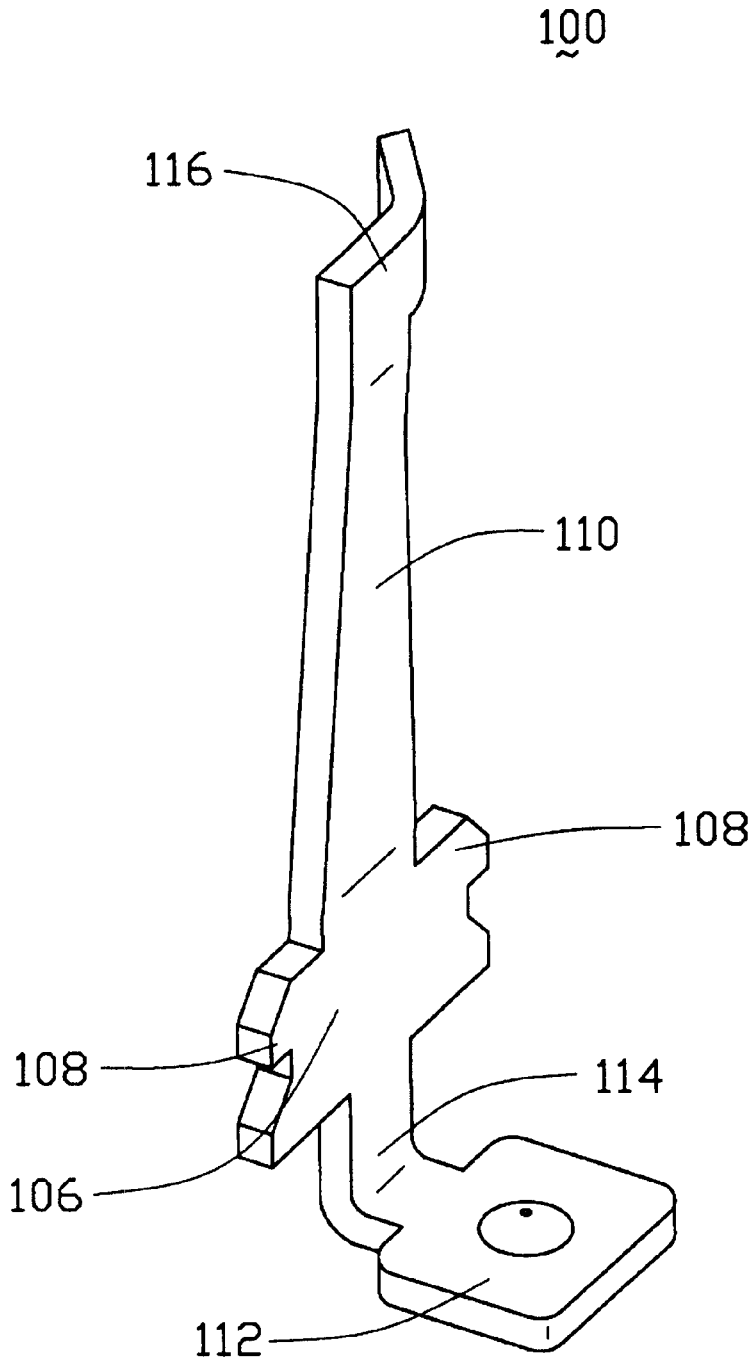
FIG. 4 is similar to FIG. 3 but showing the terminal after a second forming operation that makes a solder pad on the terminal.
Figure 6:
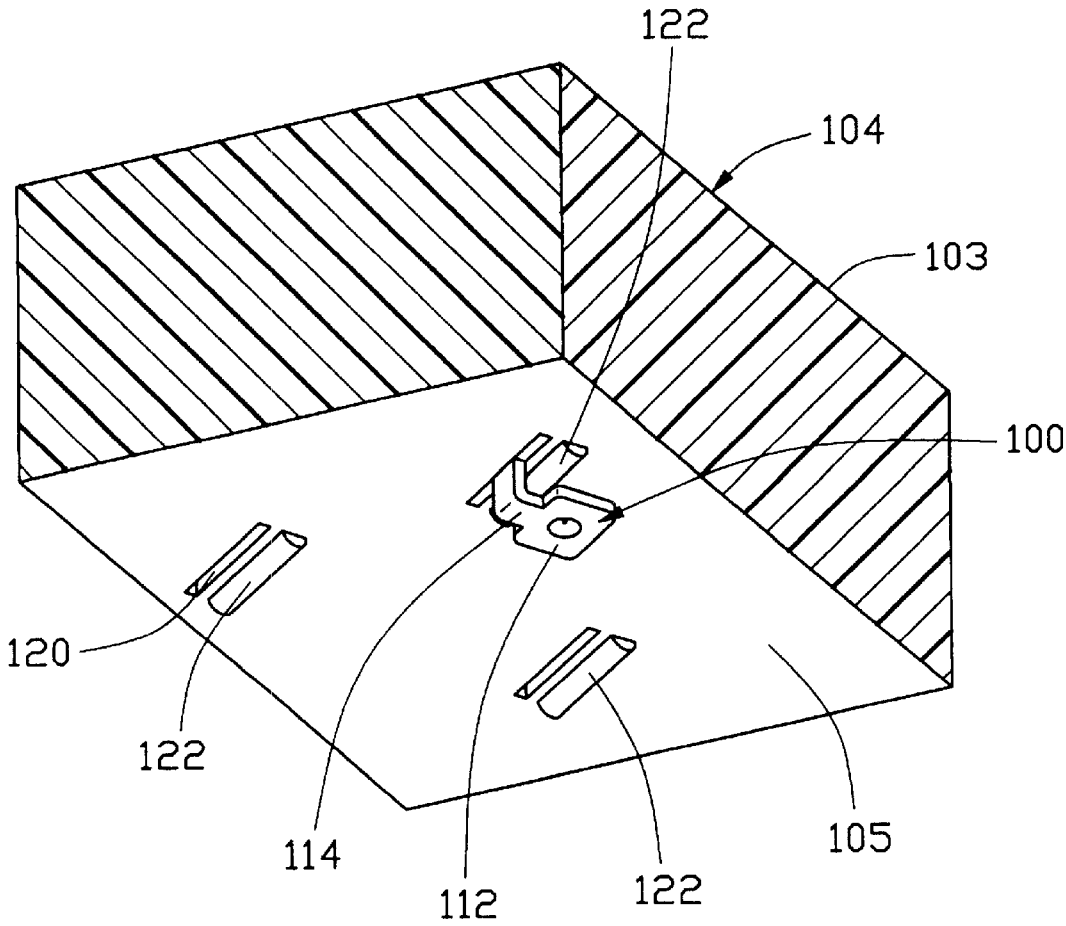
FIG. 6 is a bottom side perspective view of FIG. 5.
Figure 7:
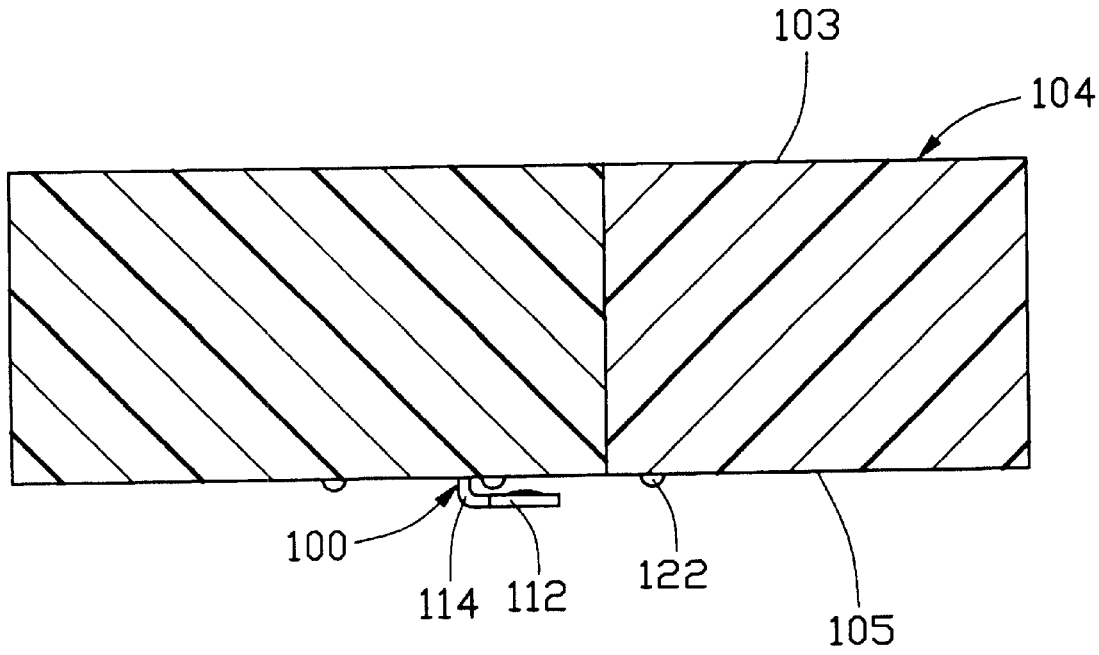
FIG. 7 is a side elevational view of FIG. 5.

Also referring to FIGS. 4, 6 and 7, after the solder pad 112 and the neck portion 114 of the terminal 100 extend through the slit 120, a second forming operation is carried on the neck portion 114. The neck portion 114 is bent an angle of approximately 90 degrees whereby the solder pad 112 is substantially perpendicular to the base section 106 and parallel to or overlapping the bottom face 105 of the housing 104 as particularly shown in FIG. 4. The bent neck portion 114 cooperates with the side extensions 108 of the base section 106 to firmly retain the terminal 100 in the cell 102. Since the second forming operation can be done on the solder pads 112 of all the terminals 100 simultaneously, a perfect alignment of all the solder pads 112 can be insured.

Since the conductive terminals 100 are usually made of metallic materials, such as copper based alloys. The solder pad 112 may spring back to certain extents which deteriorates the perfect alignment among the solder pads 112 after the second forming operation. A bump 122 is formed on the bottom face 105 next to each slit 120. Preferably, each bump 122 is extended along the slit 120. The bump 122 is sized to provide an over-forming or spring back allowance for the solder pad 112 whereby the solder pad 112 can be over bent and allows a predetermined amount of spring back which brings the solder pad 112 back to perfect alignment with each other after the second forming operation is done.

Although the present invention has been described with reference to the preferred embodiment thereof, it is apparent to those skilled in the art that a variety of modifications and changes may be made without departing from the scope of the present invention which is intended to be defined by the appended claims.

We claim:

1. A connector comprising:

a housing having top and bottom faces, the housing defining cells and each cell having an opening in the top face and a closed bottom with a slit defined in the bottom and exposed to the bottom face of the housing, a bump being formed on the bottom face associated with each slit; and a conductive terminal received in each cell through the top opening, the terminal having a base section positioned in the cell and a bottom section extending through the slit and beyond the bottom face of the housing, the bottom section being bent about the bump to be substantially parallel to the bottom face;

wherein the bump provides a spring back clearance for over-forming of the bottom section.

* * * * *